US005772685A

United States Patent [19]

Crowe et al.

[11] Patent Number: 5,772,685

[45] **Date of Patent: *Jun. 30, 1998**

[54] INFANT PACIFIER-FLUID ADMINISTERING UNIT

[76] Inventors: D. E. Crowe; Sarah E. Barron, both of 808 E. Eighth Ave., Johnson City, Tenn. 37601

[ * ] Notice: The term of this patent shall not extend beyond the expiration date of Pat. No. 5,601,605.

[21] Appl. No.: 764,600

[22] Filed: Dec. 11, 1996

Related U.S. Application Data

[63] Continuation-in-part of Ser. No. 521,121, Aug. 29, 1995, Pat. No. 5,601,605.

[51] Int. Cl.[6] ..... A61J 17/00; A61J 7/00

[52] U.S. Cl. ..... 606/236; 604/77; 604/73; 606/234

[58] Field of Search ..... 604/53, 54, 73, 604/77; 606/234–236; 215/11.1–11.6

[56] References Cited

U.S. PATENT DOCUMENTS

| | | | |
|---|---|---|---|
| 39,662 | 8/1863 | Lockwood | 604/213 |
| 406,950 | 6/1889 | Barnes | 606/234 |
| 5,582,330 | 12/1996 | Iba | 604/212 |
| 5,601,605 | 2/1997 | Crowe et al. | 606/236 |

FOREIGN PATENT DOCUMENTS

| | | | |
|---|---|---|---|
| 8802266 | 4/1988 | WIPO | 604/213 |

*Primary Examiner*—Glenn K. Dawson
*Attorney, Agent, or Firm*—Donald W. Spurrell

[57] ABSTRACT

An infants pacifier and medicine administering unit having a generally shield-shaped body with first and second sides and having an aperture extending therethrough around a generally transverse axis. The aperture being defined by a first wall. A flexible nipple having an inlet and a sucking orifice spaced therefrom, and a substantially sealed, compressible fluid dispenser having an outlet being mounted on opposite sides of the body with the inlet and the outlet being juxtaposed for fluid communication with each other thru a pressure openable valve whereby fluid in the dispenser can be injected under pressure into the nipple.

30 Claims, 4 Drawing Sheets

INFANT PACIFIER-FLUID ADMINISTERING UNIT

FIELD OF THE INVENTION

This application is a continuation-in-part of Applicant's copending Ser. No. 08/521,121 of same title, filed Aug. 29, 1995, now U.S. Pat. No. 5,601,605, and the invention concerns a unique technique and structural means for facilitating the administration of a medicinal or other dosage of fluid material to an infant. The invention particularly concerns a novel structural adoption of conventional infant pacifier structure for performing this technique in a non-invasive essentially non-irritating manner.

BACKGROUND OF THE INVENTION

The forced feeding of medicines or the like to infants, of any species, can be a nerve-wracking experience and usually produces less than a satisfactory result. One technique which is used is the sudden ejection method wherein a medicine dropper is used to eject the medicine directly and brutally into the innocent, unsuspecting, gaping mouth of the infant. Trauma typically results and a repeat, passive acceptance by the infant of the noxious material should not be expected. Other subterfuges such as mixing the bad tasting substance into the infants milk likewise has its drawbacks, such as, e.g., making your baby hate milk.

BRIEF DISCUSSION OF PRIOR ART

Heretofore, various devices have been preferred for dispensing fluid materials by nipple means simulating a pacifier, as shown in U.S. Pat. Nos. 5,013,321; 5,176,705; 5,078,734; 2,612,165; 2,889,829, the disclosure of which concerning structure retention means, materials of construction, and utility are hereby incorporated herein by reference. Such prior devices neither perform in the same manner and with equivalent efficiency as applicants unit, nor are they structurally similar thereto.

Objects therefore, of the present invention are: to provide a means for administering medicines or other unpleasant tasting substances to infants whereby the bad aspects of the experience are reduced to a minimum; to provide such a means in a form which is familiar to the infant such that the administration process is substantially unnoticeable to the infant; to provide such means in a convenient form, size and construction which is extremely easy to use, clean, refill and reuse; and to provide such means in an economical and easy to manufacturable form.

BRIEF SUMMARY OF THE INVENTION

The above and other objects hereinafter becoming evident have been attained in accordance with the present invention thru the discovery which is expressed in a broad embodiment as an infants pacifier—fluid dispenser unit comprising a generally shield—shaped stop member having first and second sides and having aperture means formed laterally therethrough along a generally transverse axis of said member and defined by transverse wall means, nipple means having an inlet end mounted on said stop member adjacent said aperture means and having an outlet end with sucking orifice means spaced from said first side generally along said transverse axis, fluid dispenser means providing fluid reservoir means and having an outlet therefor, said dispenser means being mounted on said stop member and adapted to be operated to place said reservoir means into fluid communication with said inlet end of said nipple means and cause a pressurized flow of fluid from said reservoir means to said nipple means.

In certain preferred embodiments:

(a) said wall means is generally of tubular configuration and lies intermediate said reservoir means and said nipple means, and normally closed pressure responsive valve means is provided within said wall means and is openable in response to compression of said bulb means to force fluid in said bulb means through said valve means and into said nipple means and out of the sucking orifice thereof, (b) said nipple means and dispenser means comprises an elongated single element wherein the mid-region thereof being affixed to said stop member within said wall means.

(c) valve means is positioned within said wall means and is operative to allow pressurized fluid to flow from said reservoir means into said nipple means;

(d) said valve means is positioned on said unit at any position intermediate said reservoir means and said sucking orifice means;

(d) said valve means comprises an expandable, resilient elastomeric segment having normally closed orifice means therethrough, which orifice means becomes opened upon expansion of said member under pressure applied thereagainst;

(e) said valve means is positioned in the outlet end of said bulb means;

(f) said valve means comprises a pressure rupturable member;

(g) said dispenser means comprises flexible, resilient bulb means which can be prefilled with any of a large variety of flowable materials, hereinafter termed "fluid", and including, e.g., air or solutions, slurries, or suspensions of medicines, vitamins, food supplements, or the like and wherein said valve means is positioned within the outlet of said reservoir means; and (h) said bulb means is sufficiently resilient whereby upon being compressed and then released, its expansion will generate sufficient suction to draw fluid through said suction orifice means and into said nipple means, whether or not said valve means is present.

BRIEF DESCRIPTION OF THE DRAWINGS

The invention will be further understood from the following drawings and description thereof wherein certain portions of the drawings are enlarged for clarity and wherein.

DETAILED DESCRIPTION OF THE DRAWINGS

Figure 1:
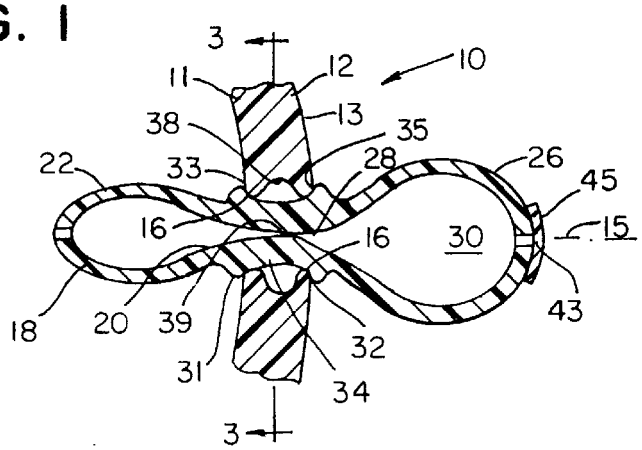
FIG. 1 is a transverse cross-sectional view of a unitary nipple-bulb dispenser embodiment of the present unit employing a reusable valve means.

Referring to the drawings, the present unit 10 in one preferred embodiment comprises a generally shield-shaped body member 12 having first and second sides 11 and 13 respectively and having aperture means 14 formed therethrough around a generally transverse axis 15, said aperture means being defined by transverse wall means 16, nipple means 18 having an inlet end 20 mounted on said body member adjacent said aperture means and having an outlet end 22 with sucking orifice means 24 spaced from said first side 11 generally along said transverse axis, resilient, compressible bulb means 26 having an outlet end 28 mounted on said stop member and adapted to communicate with said inlet end 20 of said nipple means for allowing a pressurized flow of fluid 30, i.e., liquid or air, from said bulb means to said nipple means upon compression of said bulb means.

The wall means 16 is formed preferably to provide annular shoulder means 31, 32 adapted to be contacted by mating annular shoulder means 33, 35 respectively of the nipple means and bulb means for fixing the nipple means and bulb means in position on the body member 12.

It is noted that any of the shoulder means embodiments on either the body member, the nipple means, or the bulb means may be in the form of smooth surfaces which, e.g., when a portion of the elastomeric nipple or bulb means is stretched thereover or thereinto will generate sufficient friction to maintain the nipple or bulb means on the body member against any casual force tending to disconnect them from the body member.

Figure 3:
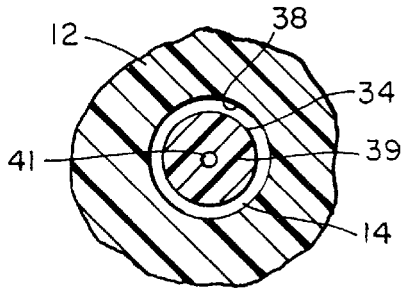
FIG. 3 is a cross-sectional view of a portion of the unit of FIG. 1 taken along line 3—3 thereof in the direction of the arrows, wherein the dispenser is pressurized and the valve means is opened thereby.
Figure 8:
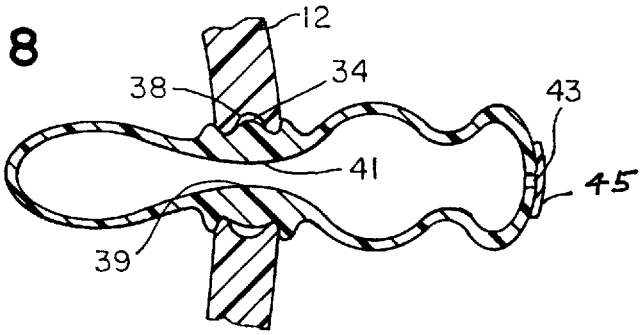
FIG. 8 is a view as in FIG. 1 with the dispenser bulb compressed and the valve means opened thereby.

In the embodiment of FIG. 1, the nipple means and bulb means jointly comprise a unitary, substantially hermetically sealed element having a longitudinal mid-region 34 of annular cross section which may be thickened for providing a normally closed sealable valve means 39 having orifice means 41. This valve means is adapted to become opened as shown in FIG. 3 and 8 only by significantly pressurizing bulb means 26 or an equivalent dispenser means, wherein said mid-region 34 is partially radially deformed outwardly into annular recess means 38 formed into wall means 16. This construction provides a reusable valve means. In this embodiment the nipple means and bulb means may of course be manufactured as separate items and assembled, e.g., by plastic welding, adhesive or the like to each other or to a portion of said body to form said element.

Figure 9:
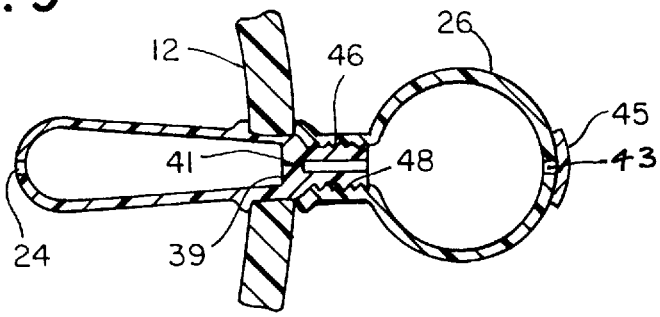
FIG. 9 shows an alternative connection of the nipple and bulb means to the body means.
Figure 10:
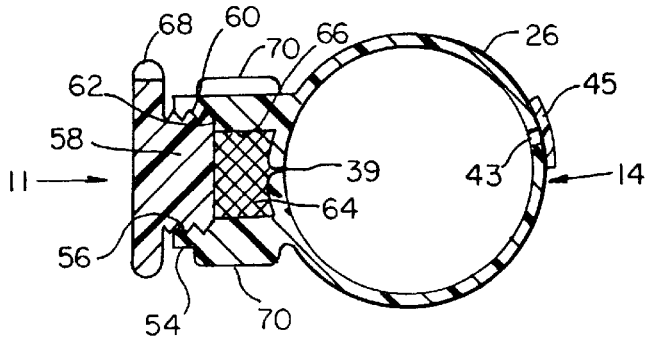
FIG. 10 is a cross-sectional view of prefilled dispenser means useful in the present invention and having an aseptic protective cover.
Figure 11:
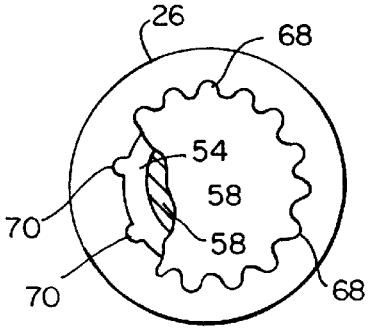
FIG. 11 is an end view taken in the direction of arrow 11 in FIG. 10 with portions of the cap means broken away.

Either or both of the bulb means or nipple means of the unit can be calibrated with measurement lines to control the amount of medicine to be administered. In one embodiment, the medicine is suctioned up into the nipple through squeezing and then relaxing the bulb. Alternatively, the nipple means can be screwed or otherwise affixed to the body means and medicine can be added to the bulb wherein different size bulbs can be used if needed for different doses. The body or stop means 12 rests on the infants lips as it sucks the pacifier nipple and ingests the medicine. The nipple and bulb can attach to the stop member through the aperture 14 by screwing the nipple and bulb together such as shown in FIG. 9 to provide a high degree of safety against the possibility of swallowing either part. In this embodiment, the threaded mating portions 46, 48 of the nipple and bulb means respectively may be thickened to provide sufficient rigidity thereto for making a firm and secure threaded connection therebetween. Medicine or other fluid in the nipple and reservoir means, or only in the nipple, or only in the bulb may be administered by either the baby sucking on the nipple or by squeezing the bulb, or both to facilitate transfer of the medicine into the baby's mouth.

Figure 7:
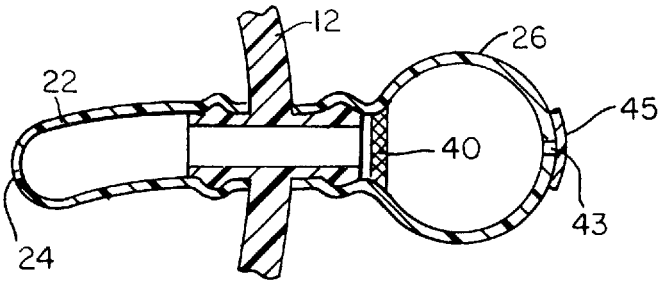
FIG. 7 is a view as in FIG. 4 showing placement of a rupturable, single use valve means in the outlet of the dispenser bulb means.

In FIG. 7 the valve means comprises a simple pressure rupturable membrane 40 which may be adhesively secured or plastic welded or the like within the wall means 16 or a portion of the bulb means or nipple means.

In each of the embodiments shown the dispensing means, e.g., bulb means 26 may be provided with a fill port 43 provided, for example, with an adhesive flap cover 45 for sealing the fluid contents within the dispenser reservoir. The dispenser may alternatively comprise a fluid containing cylinder affixed at its outlet end to member 12 and provided with a piston type plunger for pressurizing the fluid to be administered through the valve means and through the nipple means, in the nature of a hypodermic syringe.

Figure 2:
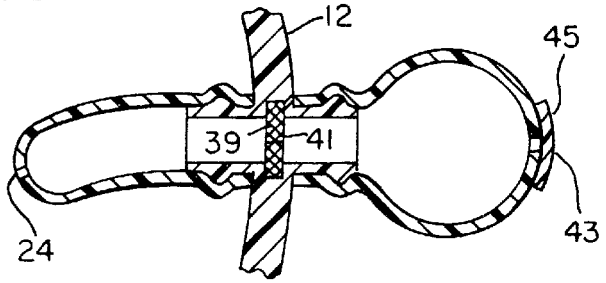
FIG. 2 is a view as in FIG. 1 of an assembleable nipple and dispenser embodiment of the present unit including a variation of the reusable valve means.
Figure 4:
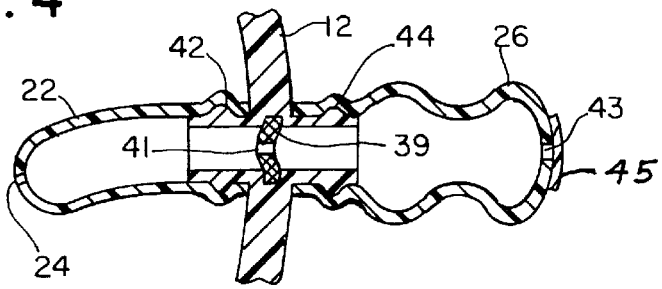
FIG. 4 is a cross-sectional view as in FIG. 2 showing the valve means in pressure-forced open position with the bulb means compressed.
Figure 5:
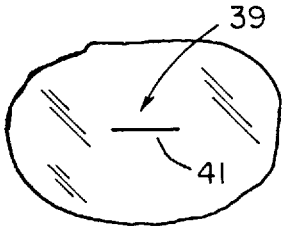
FIG. 5 is a tricuspid form of the valve of FIG. 4.
Figure 6:
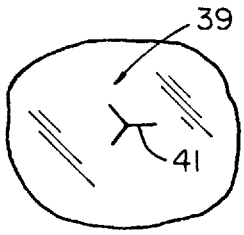
FIG. 6 is a bicuspid form of the valve of FIG. 4.

The structure employed for retaining the nipple means and dispenser on the stop member can be varied widely, as shown, for example, in FIGS. 2, 4, 7 wherein shoulder means 42, 44 are provided on the stop member and the nipple and dispensing means are tightly frictionally stretched thereover. Various other means such as the screw-on structure of FIG. 9 and those of the aforementioned patents may be employed herein for achieving such retention.

Referring to the embodiments of FIGS. 10 thru 14 the bulb means is provided as a separate element of the unit and may be merchandised, e.g., as a prefilled item packaged in a clear plastic, antiseptically sealed blister-type package generally designated by dotted lines 50 and adhesively affixed to a support board 52.

In this embodiment, the bulb means is specially formed to provide a tubular connector portion 54 provided with internal threads 56 into which a cap means 58 (also body 12) having mating threads 60 may be screwed tightly and sealingly against annular shoulder 62 provided on said connector portion. It is preferred that an antiseptic plug 64 of compressible septic and slightly absorbent material such as dense medicinal cotton or the like material be first placed into the tubular cavity 66 whereby screwing down the cap means will highly compact the plug against the valve means 39 and maintain orifice means 41 in a tightly shut condition. Such construction allows the bulb means to be prefilled with a variety of medicines, vitamin solutions, food supplements or the like and maintained in a physically safe and biologically stable condition, particularly where refrigeration is employed.

Figure 12:
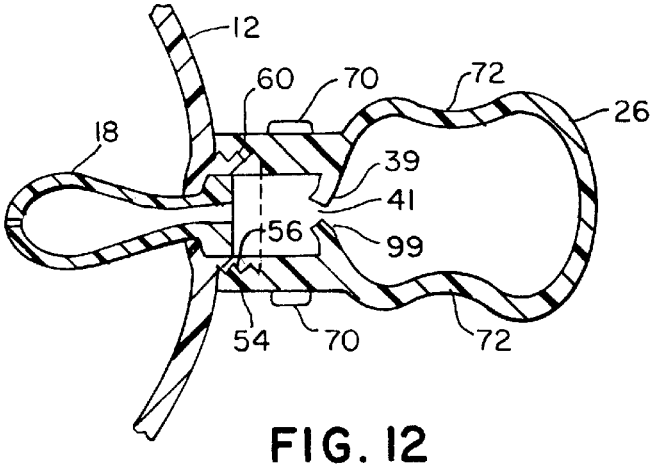
FIG. 12 is a cross-sectional view with simplified cross-hatching for clarity and showing the dispenser means in FIG. 10 in actual use.
Figure 13:
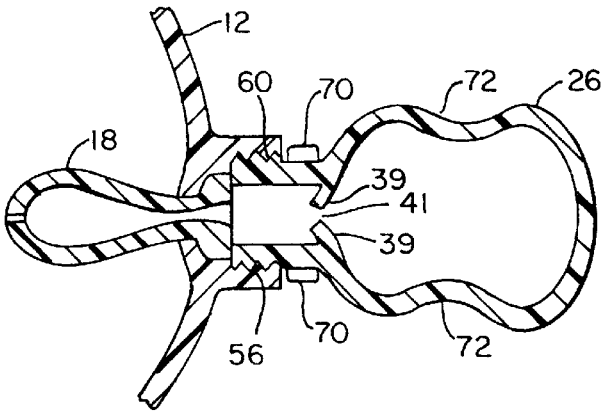
FIG. 13 is a view as in FIG. 12 showing a variation of the connector means for affixing the dispenser means to the body of the unit.
Figure 14:
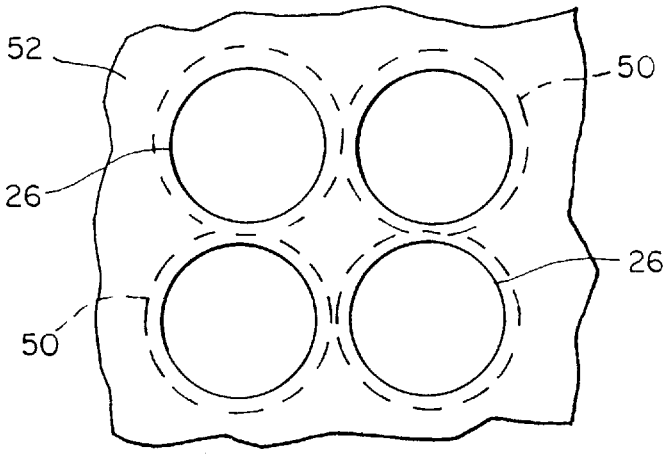
FIG. 14 is a view taken in the direction of the arrow 14 in FIG. 10 and showing a plurality of the present units, either empty or with the bulb prefilled, mounted by, e.g., blister packaging on a base.
Figure 15:
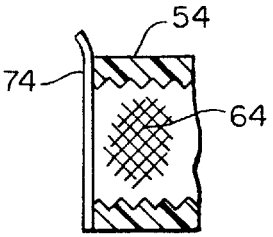
FIG. 15 is a view as in FIG. 10 showing the use of an adhesive foil sealing tab 74, whether or not the valve 39 is on the bulb or is elsewhere in the unit.

In this embodiment, the plug 64 may be affixed to the cap means by mechanical or adhesive means to facilitate its use. Also, the cap means 58 is preferably provided with finger grips such as 68, and the connector portion 54 with equivalent finger grips such as 70 such that the firmly screwed down and hermetically, antiseptically sealed cap means can be readily unscrewed from the bulb means without gripping and squeezing or otherwise mishandling the bulb means and its contents. Removal of plug 64 then allows the prefilled bulb means to be assembled onto the unit as shown in FIG. 12 or 13 depending on the selected location of the threads 56 and 60, and the bulb then compressed as at 72 to eject fluid thru the open orifice means 41 and on into the nipple means.

The invention has been described in detail with particular reference to preferred embodiments thereof, but it will be understood that variations and modifications will be effected with the spirit and scope of the invention.

We claim:

1. A fluid dosage administering unit comprising a generally shield shaped body means having first and second sides and having aperture means therethrough around a generally transverse axis, said aperture means being defined by first wall means, flexible nipple means in the form of an infants pacifier nipple having an inlet and a sucking orifice means spaced from said inlet, fluid dispenser means having fluid reservoir means and a fluid outlet therefor, said nipple means and dispenser means being mounted on opposite sides of said body means with said inlet and said outlet being adapted for fluid communication with each other wherein passage means is provided for placing said reservoir means in fluid communication with said sucking orifice means whereby fluid in said reservoir means can be injected under pressure into said nipple means and out through said sucking orifice means, and wherein pressure responsive valve means is provided within said passage means whereby fluid in said reservoir means is caused to flow thru said valve means and out of said sucking orifice means upon pressurizing the fluid in said reservoir means.

2. The unit of claim 1 wherein said nipple means and dispenser means are provided as a single elongated element with a longitudinal mid-region thereof being mounted on said body means within said wall means in fixed position along said axis.

3. The unit of claim 2 wherein said body means and said element are provided with cooperating snap-together shoulder means whereby said element can be removably fixed in position along said axis.

4. The unit of claim 1 wherein said body means, said nipple means and said dispenser means are provided with cooperating snap-together shoulder means for individually removably fixing said nipple means and said dispenser means on said body means.

5. The unit of claim 1 wherein said dispenser means is provided with port means for providing for filling of said reservoir means with fluid.

6. The unit of claim 1 wherein said dispenser means is in the form of compressible bulb means.

7. The unit of claim 6 wherein said bulb means is provided with sealable port means for providing for filling said bulb means with fluid.

8. The unit of claim 6 wherein said nipple means and bulb means jointly comprise a unitary, substantially hermetically sealed element having a longitudinal mid-region, the exterior surface of said mid-region frictionally engaging said wall means to fix said element in position on said body means.

9. The unit of claim 8 wherein said valve means comprises a deformable, resilient elastomeric segment within said mid-region providing normally closed orifice means therethrough which becomes opened upon deformation of said segment by pressure applied thereagainst.

10. The unit of claim 6 wherein said bulb means is selectively detachable and attachable with respect to said body means and is prefilled with medicinal or other fluid material, and wherein said valve means is positioned within the outlet of said bulb means such that said bulb means and its contents can be refrigerated or otherwise maintained in a chemically stabilized or sterilized condition and then affixed to said body means when dispensing of said fluid to an infant is desired.

11. The unit of claim 10 wherein said bulb means is provided with sealable port means for providing for filling said reservoir means with fluid.

12. The unit of claim 1 wherein said valve means comprises a pressure-rupturable membrane.

13. The unit of claim 1 wherein said valve means is positioned within and affixed to said wall means.

14. The unit of claim 1 wherein said valve means is positioned in the outlet of said dispenser means.

15. The unit of claim 1 wherein said dispenser means comprises a first shoulder means having screw type threads, and wherein second shoulder means on said body means comprises mating screw type threads.

16. The unit of claim 15 wherein said dispenser means comprises an elastomeric, compressible, bulbous wall means having a tubular connector portion provided with said first shoulder means, wherein the bore of said connector portion is in communication with said fluid outlet.

17. A fluid dosage administering unit comprising a generally shield shaped body means having first and second sides and having aperture means therethrough around a generally transverse axis, said aperture means being defined by first wall means, flexible nipple means in the form of an infants pacifier nipple having an inlet and a sucking orifice means spaced from said inlet, fluid dispenser means having fluid reservoir means and a fluid outlet therefor, said nipple means and dispenser means being assembled on said body means to provide an elongated, substantially hermetically sealed structure having a longitudinal mid-region thereof in fixed position along said axis with respect to said body means with said nipple means and said dispenser means being thereby positioned on opposite sides of said body means with said inlet and said outlet being adapted for fluid communication with each other through a passage means for placing said reservoir means in fluid communication with said sucking orifice means whereby fluid initially in the nipple and reservoir means, or only in the reservoir means, or only in the nipple may be administered by either the baby sucking on the nipple or by squeezing the reservoir means, or both, to facilitate transfer of the fluid into the baby's mouth, and wherein pressure responsive valve means is provided within said passage means whereby fluid in said reservoir means is caused to flow through said valve means and out of said sucking orifice means upon pressurizing the fluid in said reservoir means relative to the pressure in said nipple.

18. The unit of claim 17 wherein said nipple means and dispenser means are each provided with first shoulder means, and wherein said body means is provided with a pair of second shoulder means, whereby said structure can be removably fixed in position along said axis by engagement of said first shoulder means with said second shoulder means.

19. The unit of claim 17 wherein said dispenser means is provided with port means for providing for filling of said reservoir means with fluid.

20. The unit of claim 17 wherein said dispenser means is in the form of compressible bulb means.

21. The unit of claim 20 wherein said bulb means is provided with sealable port means for providing for filling said bulb means with fluid.

22. The unit of claim 17 wherein said valve means is positioned within said first wall means, and affixed to a wall portion of said nipple means, or a wall portion of said dispenser means.

23. The unit of claim 17 wherein said valve means comprises a deformable, resilient elastomeric segment of said mid-region normally closing said passage which becomes opened upon deformation of said segment by pressure applied thereagainst.

24. The unit of claim 17 wherein said valve means is positioned in the outlet of said dispenser means.

25. The unit of claim 17 wherein annular recess means is provided in said wall means of said body means into which said mid-region of said element is partially radially deformed by pressure within said passage.

26. A dispenser and pacifier combination for dispensing fluids under pressure said pacifier having a flexible nipple affixed to a body member, said dispenser comprising elastomeric wall means formed to provide compressible bulb means having a tubular connector portion extending outwardly from said wall means and formed to provide a bore means and first shoulder means, said first shoulder means being adapted for removable connecting said dispenser to said body member of said pacifier wherein said bore means is in communication with fluid outlet means provided thru said wall means and lying within the adjacent perimeter of said bore means, and valve means in said fluid outlet means and adapted to allow fluid flow from said bulb means thru said bore means and into said nipple upon compression of said bulb means.

27. The dispenser means of claim 26 wherein cap means is provided for sealing said bore means and having second shoulder means adapted for removable engagement with said first shoulder means for removably sealingly connecting said cap means to said connector portion.

28. The dispenser means of claim 27 wherein removable antiseptic plug means is provided in said bore means and is compressed by said cap means against said outlet means for enhancing the sealing action of said valve means.

29. A dispenser means for dispensing fluids under pressure and adapted for use in conjunction with an infant's pacifier having a nipple affixed to a body member, said dispenser means comprising elastomeric wall means formed to provide compressible bulb means having a tubular connector portion extending outwardly from said wall means and formed to provide flexible expandable tubular shoulder means and a bore means having outlet means, said shoulder means being adapted for removably connecting said dispenser means to a regul tubular portion of said body member of said pacifier wherein said bore means is in communication with fluid outlet means provided thru said wall means and lying within the adjacent perimeter of said bore means, and removable sealing cover means fixed to said connector portion and covering over said outlet means whereby said bulb means can be prefilled with fluid and sealed for future use.

30. The dispenser of claim 29 wherein said cover means comprises a thin, metal foil, pealable tab adhesively secured to said connector portion.

* * * * *